US006418605B1

(12) United States Patent
Kettner

(10) Patent No.: US 6,418,605 B1
(45) Date of Patent: Jul. 16, 2002

(54) METHOD AND APPARATUS OF APPLYING SLIDER DEVICE TO A RECLOSEABLE ZIPPER ARRANGEMENT

(75) Inventor: Catherine E. Kettner, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/611,236

(22) Filed: Jul. 6, 2000

(51) Int. Cl.[7] ..... B21D 53/50; A41H 37/06
(52) U.S. Cl. ..... 29/408; 29/768; 29/33.2
(58) Field of Search ..... 29/408, 768, 332

(56) References Cited

U.S. PATENT DOCUMENTS

| | | | | |
|---|---|---|---|---|
| 2,879,588 A | | 3/1959 | Morin | |
| 3,426,396 A | | 2/1969 | Laguerre | |
| 3,701,191 A | | 10/1972 | Laguerre | |
| 3,701,192 A | | 10/1972 | Laguerre | |
| 3,714,698 A | | 2/1973 | Fukuroi | |
| 3,815,208 A | | 6/1974 | Kawakami | |
| 4,819,318 A | | 4/1989 | Sodeno | |
| 5,007,142 A | | 4/1991 | Herrington | |
| 5,283,932 A | | 2/1994 | Richardson et al. | |
| 5,297,320 A | | 3/1994 | Keyaki et al. | |
| 5,426,830 A | | 6/1995 | Richardson et al. | |
| 6,161,271 A | * | 12/2000 | Schreiter | 29/408 |
| 6,199,256 B1 | * | 3/2001 | Revnew et al. | 29/408 |

* cited by examiner

*Primary Examiner*—P. W. Echols
(74) *Attorney, Agent, or Firm*—Tracey D. Beiriger

(57) ABSTRACT

A method for mounting a slider device on a recloseable package includes mounting the slider device by providing a package having a recloseable closure mechanism and providing a slider device for opening and closing the recloseable closure mechanism, the slider device having first and second leg constructions having a first distance therebetween. The method also includes, expanding the slider device to increase the first distance between the first and second leg constructions to a second distance, wherein the expanding includes inserting an expanding device into a slide channel between first and second leg constructions and moving the first leg construction away from the second leg construction. Then removing the slider device from the expanding device and mounting the slider device onto recloseable closure mechanism. Finally, decreasing the second distance between the first and second leg constructions to third distance. Apparatus is also disclosed.

17 Claims, 5 Drawing Sheets

METHOD AND APPARATUS OF APPLYING SLIDER DEVICE TO A RECLOSEABLE ZIPPER ARRANGEMENT

FIELD

This disclosure generally relates to closure arrangements for polymer packages, such as plastic bags. In particular, this disclosure relates to recloseable closure mechanisms or zipper-type closures for packages, methods, and apparatus for applying slider devices to zipper-type closures.

BACKGROUND

Many packaging applications use resealable containers to store or enclose various types of articles and materials. These packages may be used to store food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. In some instances, providing products in resealable packages appreciably enhances the marketability of those products.

Some types of resealable packages are opened and closed using a slider device. Sliding the slider device in a first direction opens the package to allow access to the interior of the package, and sliding the slider device in an opposite second direction seals the package. The slider device typically includes a separator or spreader-type structure at one end that opens and closes a profiled closure mechanism on the resealable package, depending on the direction of movement. The sidewalls of the slider device are configured so that the sidewalls engage the closure profiles and progressively move them into engagement to close the resealable package when the slider device is moved along the closure mechanism in a direction opposite the first direction.

With the growing popularity of these slider closure mechanisms, there is a desire to improve the processes used to attach the slider device to the resealable package with the profiled closure mechanism.

SUMMARY

This disclosure relates to methods of mounting a slider device onto flexible packages comprising a recloseable closure mechanism, such as a "zipper-type" closure mechanism.

In particular, one aspect relates to a method of mounting a slider device on a recloseable closure arrangement for a recloseable package. Preferred methods include mounting the slider device onto the closure arrangement by providing a package having a recloseable closure mechanism and providing a slider device for opening and closing the recloseable closure mechanism, the slider device having first and second leg constructions having a first distance therebetween. The method also includes expanding the slider device to increase the first distance between the first and second leg constructions to a second distance, wherein the expanding includes inserting an expanding device into a slide channel between first and second leg constructions and moving the first leg construction away from the second leg construction. Then removing the slider device from the expanding device and mounting the slider device onto recloseable closure mechanism. Finally, decreasing the second distance between the first and second leg constructions to a third distance.

Further, an apparatus for mounting a slider device to a recloseable closure mechanism is described. The slider device has a first and second opposite leg constructions and a first distance therebetween. Preferably, apparatus includes a slider device positioner system including a rotating carousel, a slider distorting apparatus including an expanding device with four contact surface fingers adapted to insert into a slider side channel and expand at least one of the first and second leg constructions from the first distance to a second distance and a slider mounting system constructed and arranged to align the slider device with the recloseable closure mechanism.

Other described methods of mounting a slider device on a recloseable closure mechanism for a resealable package include positioning the slider device by using a rotating carousel comprising a plurality of radially extending posts, each post having an expanding device including four insertion fingers thereon, and each post constructed and arranged to engage the slider device. Preferably, the method includes moving the slider device along a radial path of the carousel and expanding the slider device to increase the first distance between the first and second leg constructions to a second distance. The second distance is decreased between the first and second leg constructions to a third distance. Further, then steps of mounting the slider device onto recloseable closure mechanism and removing the slider device from the expanding device are conducted.

DETAILED DESCRIPTION

A. The Package and Closure Construction

Figure 1:
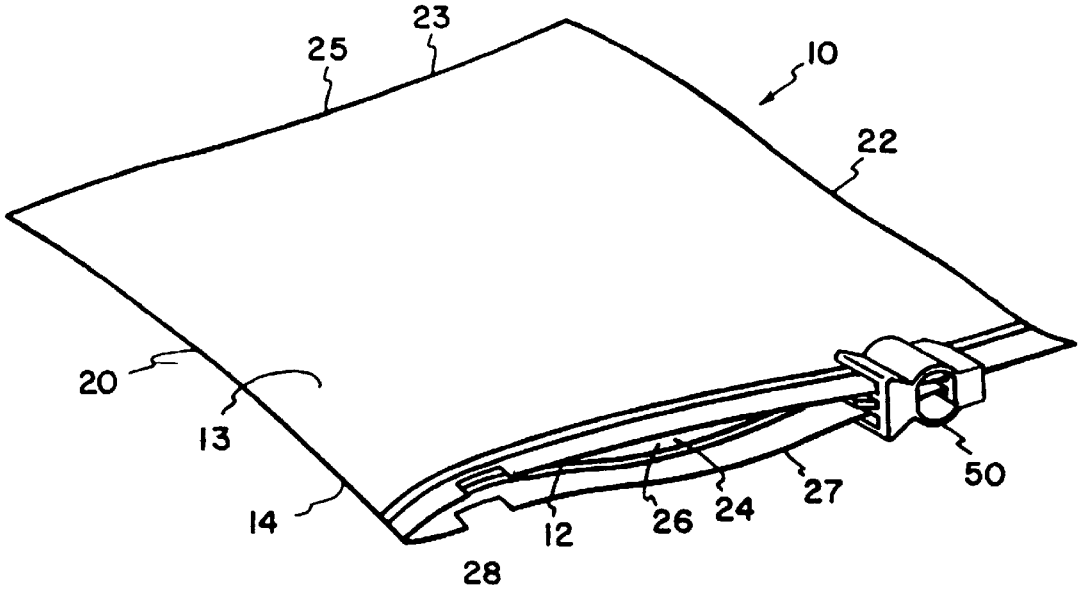
FIG. 1 is a perspective view of a flexible, recloseable package having a slider device.

Attention is directed to FIG. 1, which illustrates an example packaging arrangement in the form of a recloseable, flexible package 10, for example, a polymeric package such as a plastic bag, having a recloseable closure mechanism 12, for example, interlocking profiled elements, and a slider device for opening and closing the closure mechanism 12. In addition to being recloseable, package 10 may be resealable; that is, closure mechanism 12 not only closes package 10 but also seals package 10.

The flexible package 10 includes first and second opposed panel sections 13, 14, typically made from a flexible, polymeric, plastic film. With some manufacturing applications, the first and second panel sections 13, 14 are heat-sealed together along two side edges 20, 22 and meet at a fold line 23 in order to form a three-edged containment section for a product within an interior 24 of the package 10. In the embodiment shown, the fold line 23 comprises the bottom edge 25 of the package 10. Alternatively, two separate panel sections 13, 14 of plastic film may be used and heat-sealed together along the two side edges 20, 22 and at the bottom edge 25. Access is provided to the interior 24 of the package 10 through a mouth 26 at a top edge 27 of the package 10. In the particular embodiment shown, the mouth 26 extends the width of the package 10.

The closure mechanism 12 is illustrated in FIG. 1 at the mouth 26 of the flexible package 10. Alternatively, the closure mechanism 12 could be positioned on the package 10 at a location different from the mouth 26 of the package 10, depending on the application needs for the package 10. The closure mechanism 12 can be one of a variety of closure mechanisms. In the particular embodiment illustrated in FIG. 2, the recloseable closure mechanism 12 is shown in the specific form of a zipper-type closure mechanism. By the term "zipper-type closure mechanism," it is meant a structure having opposite interlocking or mating profiled elements that under the application of pressure will interlock and close the region between the profiles.

Figure 2:
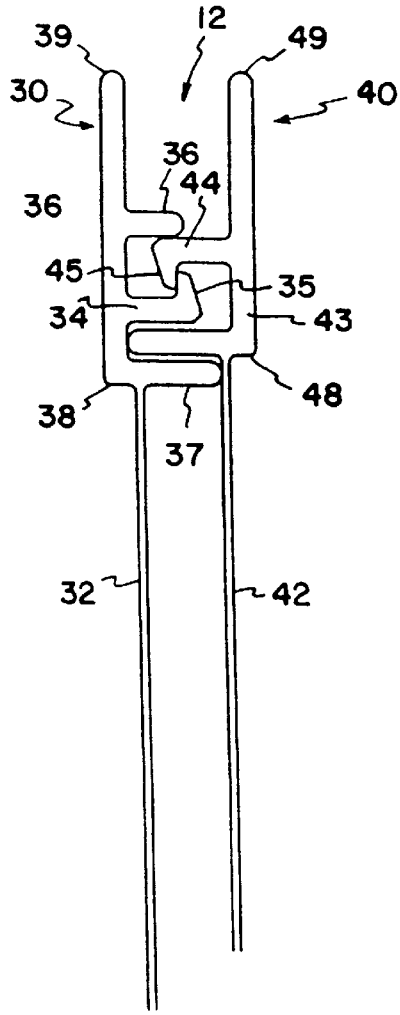
FIG. 2 is a cross-sectional view of profiled elements usable with the recloseable package of FIG. 1.

In particular, the zipper-type closure mechanism in FIG. 2 is an illustration of one example of a closure mechanism 12. The closure mechanism 12 includes an elongated first closure profile 30 and an elongated second closure profile 40. Typically, the closure profiles 30, 40 are manufactured separately from each other.

Still in reference to FIG. 2, the preferred first closure profile 30 depicted includes a sealing flange or bonding strip 32, a base strip 33, a first closure member 34, first and second guide posts 36, 37, and an upper flange 39. The closure member 34 extends from the base strip 33 and is generally projecting from the base strip 33. At a free end or tip of the closure member 34 is a hook or catch 35. The guide posts 36, 37 also extend from the base strip 33 and are generally projecting from the base strip 33. The guide posts 36, 37 aid in holding the closure mechanism 12 closed and in aligning the first closure profile 30 with the second closure profile 40 for interlocking. The bonding strip 32 depends or extends downward from the second guide post 37 and can be attached to a first panel section, such as the first panel section 13 of the package 10 of FIG. 1. A first shoulder 38 is defined by the intersection of the base strip 33 and bonding strip 32. In the example illustrated, the bonding strip 32 is spaced a distance laterally from the base strip 33 to define a corner forming the shoulder 38. The upper flange 39 extends upwardly from the base strip 33 and first guide post 36.

The preferred second closure profile 40 depicted includes a bonding strip 42, a base strip 43, a closure member 44, a guide post 46, and an upper flange 49. The closure member 44 extends from the base strip 43 and is generally projecting from the base strip 43. At a free end or tip of the closure member 44 is a hook or catch 45. The guide post 46 also extends from the base strip 43 and is generally projecting from the base strip 43. The guide post 46 aids in holding the closure mechanism 12 closed and aids in aligning the second closure profile 40 with the first closure profile 30 for interlocking. The bonding strip 42 depends or extends downward from the guide post 46 and can be attached to a second panel section, such as the second panel section 14 of the package 10 of FIG. 1. A shoulder 48, analogous to the shoulder 38, is formed at the comer of the bonding strip 42 and guide post 46.

The first and second closure profiles 30, 40 are designed to engage with one another to form the recloseable closure mechanism 12. The closure member 34 of the first closure profile 30 extends from the base strip 33 an engagement distance. The closure member 44 of the second closure profile 40 also extends from the base strip 43 an engagement distance. These engagement distances that the closure members 34, 44 extend are sufficient to allow mechanical engagement, or interlocking, between the first closure member 34 of the first closure profile 30 and the closure member 44 of the second closure profile 40. In particular, the catches 35, 45 hook or engage each other. Furthermore, the closure profiles 30, 40 are sealed together at their ends, such as at side edges 20, 22 in FIG. 1, to further aid in aligning the closure profiles 30, 40 for interlocking through processes such as ultrasonic crushing or welding. Pressure is applied to the closure profiles 30, 40 as they engage to form the openable sealed closure mechanism 12. Pulling the first closure profile 30 and the second closure profile 40 away from each other causes the two closure profiles 30, 40 to disengage, opening the package 10 of FIG. 1. This provides access to the interior 24 of the package 10 through the mouth 26.

In some applications, the closure profiles 30, 40 are formed by two separate extrusions or through two separate openings of a common extrusion. Typically, the closure mechanism 12 is made of a polymer, plastic material, such as polyethylene or polypropylene. In one example embodiment, the closure arrangement illustrated in FIG. 2 is manufactured using conventional extrusion and heat sealing techniques.

Figure 5:
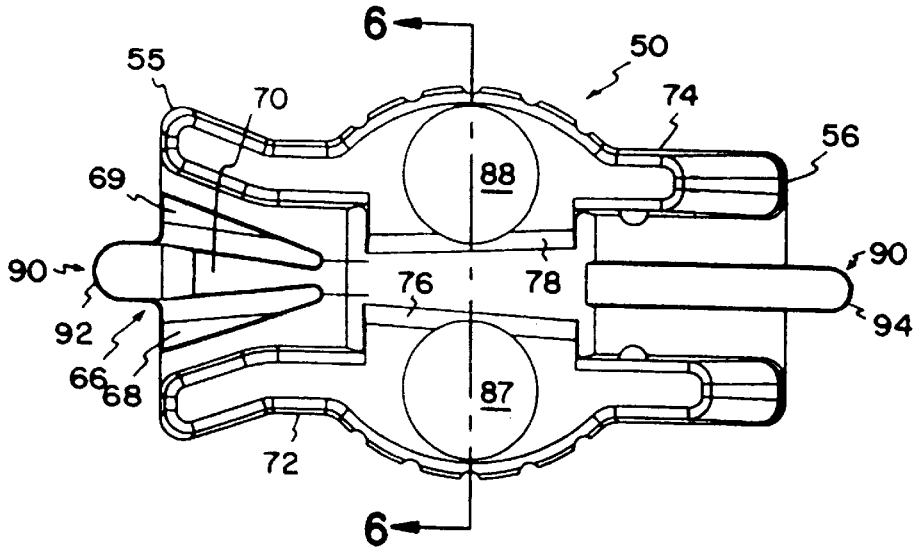
FIG. 5 is a bottom plan view of the slider device depicted in FIGS. 3 and 4.

Attention is again directed to FIG. 1. In FIG. 1, note that there is a cutout or notch 28 formed in the upper flanges 39, 49 (FIG. 2) of the closure mechanism 12. The preferred notch 28 shown includes three straight edges or sides and is formed twice as long as the length of the spreader 66 of slider 50 (FIG. 5). As to be explained in further detail below, the notch 28 serves as a "parking place" for a slider device 50 and may also facilitate mounting the slider device 50 onto the recloseable package 10 during initial assembly. In addition, the edge closest to the side seal 20 helps to create a stop member for the slider device 50.

B. The Slider Device Construction

Figure 3:
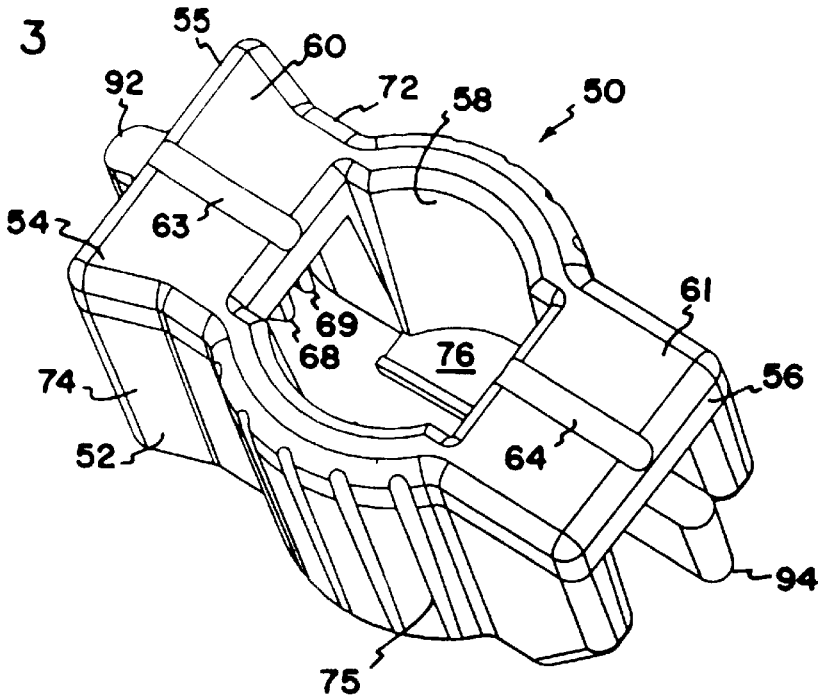
FIG. 3 is an enlarged, top perspective view of the slider device of FIG. 1.
Figure 4:
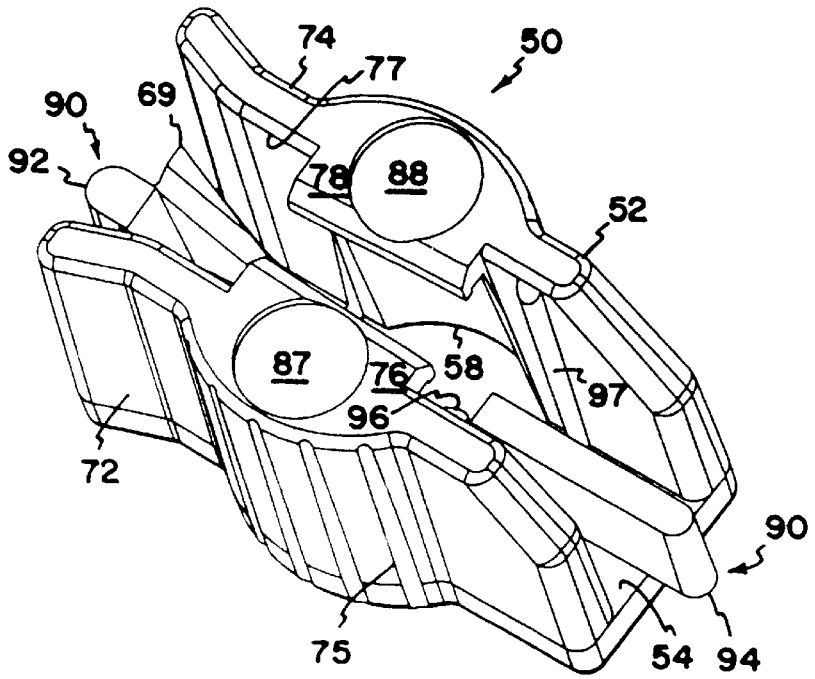
FIG. 4 is an enlarged, bottom perspective view of the slider device of FIGS. 1 and 3.

Still referring to FIG. 1, the slider device 50 is provided to open and close the closure mechanism 12. Attention is now directed to FIGS. 3 and 4. One preferred slider device 50 is illustrated in FIGS. 3 and 4 in perspective view and preferably comprises a one-piece unitary, molded plastic member with no moveable parts. In general, the slider device 50 includes a housing 52 for slidably engaging the closure mechanism 12. The housing 52 is movable between a closed position of the package 10 when the housing 52 is adjacent the side edge 20 and an open position of the package 10 when the housing 52 is adjacent the side edge 22. FIG. 1 illustrates the recloseable package 10 in an predominantly open position. The housing 52 slides over the resealable closure mechanism 12 relative to the top edge 27 of the resealable package 10 to open and close mouth 26.

The housing 52 is preferably a multi-sided container configured for engaging or locking onto or over the closure mechanism 12. In the particular embodiment illustrated in FIGS. 3 and 4, the housing 52 includes a top wall 54. By the term "top", it is meant that in the orientation of the slider device 50 shown in FIG. 3, the wall 54 is oriented above the remaining portions of the housing 52. It should be understood, of course, that if the housing 52 is moved from the orientation shown in FIG. 3, the top wall 54 will not be in a top orientation. The top wall 54 defines a first end 55 and an opposite second end 56. The top wall 54 also defines an open aperture 58. The open aperture 58 divides the top wall 54 between a first portion 60 and a second portion 61. The first portion 60 generally comprises a flat, planar portion in extension from a periphery of the open aperture 58 to the edge defined by the first end 55. Similarly, the second portion 61 generally comprises a flat, planar portion in extension from a periphery of the open aperture 58 to the edge defined by the second end 56. Each of the first and second portions 60, 61 defines a groove 63, 64 respectively. The aperture 58 and grooves 63, 64 aid in providing a structure that may be more easily injection molded.

The housing 52 includes a separation structure for separating the first and second closure profiles 30, 40. That is, when the closure mechanism 12 is in a closed state such that the closure members 34, 44 are interlocked, the separation structure will apply a force to wedge open and pull the closure members 34, 44 apart from each other. In the embodiment illustrated, the housing 52 includes a plow or spreader 66 operating as a separation structure. The spreader 66, in the preferred embodiment shown, extends or depends from the top wall 54. Preferably, the spreader 66 comprises first and second angled wedges 68, 69 separated by a gap 70 (FIG. 5) therebetween.

In FIG. 5, it can be seen that the first and second wedges 68, 69 are angled toward each other, from the first end 55 of the slider device 50 to an opposite end of the wedges 68, 69, to form an overall triangular shaped spreader 66. The gap 70 between the first wedge 68 and second wedge 69 helps to contribute to convenient manufacturing techniques for the housing 52, such as injection molding. Preferably, the spreader 66 only extends partially in the closure mechanism 12. More preferably, the spreader 66 only extends between the open flanges 39, 49 and does not penetrate the closure members 34, 44. This helps to ensure a leak-proof closure mechanism 12. In the preferred embodiment shown, the spreader 66 preferably extends about 0.125 inch from the first portion 60 of the top wall 54.

In reference again to FIGS. 3 and 4, the preferred housing 52 shown also includes first and second side walls 72, 74. Preferably, each of the first and second sidewalls 72, 74 extends from and is cantilevered from the top wall 54 to form a slide channel 77 therebetween. In preferred embodiments, the first and second sidewalls 72, 74 are injection molded with the remaining parts of the housing 52. In other words, preferably the housing 52 comprises a single, unitary, integral piece of material with no additional materials welded, fastened, or bolted together. As can be viewed in FIGS. 3 and 4, the sidewalls 72, 74 can include texturization, such as ribs 75, to help improve gripping and handling by the user. In FIG. 5, note that the sidewalls 72, 74 diverge away from each other at the first end 55 in the first portion 60; form convex portions in a middle section; and are generally parallel in the second portion 61. These features also facilitate gripping and handling by the user.

Preferably, the housing 52 includes a system for permitting the housing 52 to slide along the closure mechanism 12 without becoming disengaged from the recloseable package 10. In the embodiment illustrated, the system of the slider housing 52 engages or interlocks with certain structure of the closure mechanism 12. In particular, the housing 52 has a first and a second engaging leg construction 76, 78. The first leg construction 76 preferably extends from the first sidewall 72 in a portion of the housing 52 that is under the open aperture 58. As illustrated in FIGS. 3 through 7, the leg constructions are preferably hooking constructions 76, 78.

Figure 6:
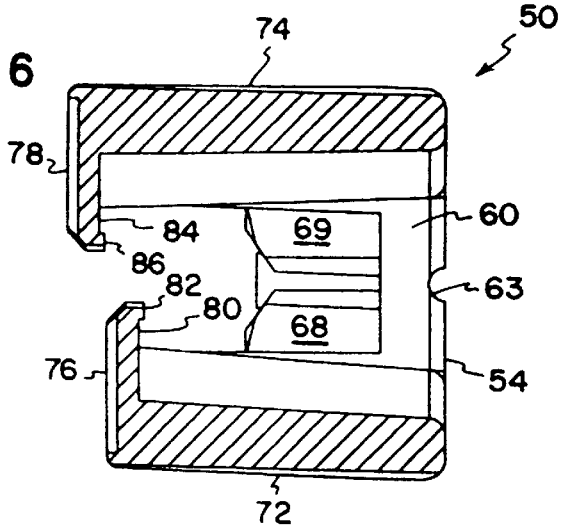
FIG. 6 is a cross-sectional view of the slider device depicted in FIG. 5 taken along the line 6—6 of FIG. 5.

In reference now to FIG. 6, first hooking construction 76 preferably includes a flange 80 in lateral extension from the first sidewall 72. Extending or projecting from flange 80 is a tip 82 oriented toward the top wall 54. As such, the tip 82, in combination with the flange 80, forms a hook or catch for slidable engagement with the shoulder 48 of the second closure profile 40.

Analogously, second hooking construction 78 preferably extends from the second sidewall 74 and includes a flange 84 in extension from the second sidewall 74 and in a region of the housing 52 below the open aperture 58. A tip 86 projects or extends from flange 84 in a direction oriented toward the top wall 54. As such, the flange 84 and tip 86 cooperate to form a hook or catch for engaging in a slidable manner with the shoulder 38 of the first closure profile 30. As can be seen in FIG. 6, the first hooking construction 76 is located closer to the top wall 54 than the second hooking construction 78. This is generally because, in the embodiment shown, the second sidewall 74 is longer than the first sidewall 72.

Attention is again directed to FIGS. 4 and 5. Each of the first and second hooking constructions 76, 78 has circular, partial cavities 87, 88, respectively, formed therein. These cavities 87, 88 help facilitate convenient manufacturing techniques, such as injection molding.

The slider device 50 preferably includes a system for guiding the slider device 50 between the side edges 20, 22 (FIG. 1) and for preventing the slider device 50 from sliding off the edge of the package 10 (FIG. 1). In the embodiment illustrated, the system includes a guide construction 90 (FIG. 4). Preferably, the guide construction 90 is designed to project beyond the first and second ends 55, 56 of the top wall 54. This ensures that the guide construction 90 detects the side edges 20, 22 before any other structure on the housing 52 engages the sides 20, 22 of the package 10. Preferably, the guide construction 90 depends from the top wall 54, but could depend from other portions of the housing 52 in other embodiments.

While a variety of structures are contemplated, in the particular embodiment illustrated in the drawings, the guide construction 90 comprises first and second bumpers or elongate fingers 92, 94. The first bumper or finger 92 preferably is molded as part of the housing 52 to extend a distance of at least about 0.06 inch (1.5 mm) beyond the first end 55 of the first portion 60. The second bumper or finger 94 likewise is preferably molded as part of the housing 52 to extend a distance of at least 0.06 inch (1.5 mm) beyond the second end 56 of the second portion 61.

In operation, the first finger 92 will abut or engage the side edge 20 to help contribute to preventing the housing 52 from sliding off of the recloseable package 10. Analogously, the second finger 94 will abut or engage the side edge 22 to prevent the housing 52 from sliding off of the recloseable package 10. Thus, the guide construction 90 keeps the housing 52 within the boundaries or periphery defined by the side edges 20 and 22.

Attention is again directed to FIGS. 4 and 5. In the preferred embodiment, the housing 52 includes a system for reducing drag. That is, the housing 52 is designed such that the surface area contact between the housing 52 and the closure mechanism 12 is minimal. In the embodiment illustrated, the system includes first and second drag reducing standoffs 96, 97. The first standoff 96 preferably projects or extends from the first sidewall 72 as a protrusion or pin or rod. Likewise, the second standoff 97 projects or extends from the second sidewall 74. In the preferred embodiment illustrated, the first and second standoffs 96, 97 project at least about 0.0085 inch (0.22 mm) from their respective sidewalls 72, 74. Preferably, the first standoff 96 extends the entire length between the bottom of the first sidewall 72 and the top wall 54. Likewise, preferably the second standoff 97 extends the entire length between the top wall 54 and the bottom edge of the second sidewall 74.

In operation, the standoffs 96, 97 slidably communicate with the first and second closure profiles 30, 40, respectively. Because of the projection and extension of the standoffs 96, 97 relative to the remaining portions of the housing 52, the amount of surface area contact or material inducing friction between the housing 52 and the recloseable closure mechanism 12 is minimized. This permits easier manipulation of the slider device 50 by the user.

To operate, the slider device 50 may be slid relative to the recloseable closure mechanism 12 in a first direction or an opposite second direction. As the housing 52 is moved from the closed position to the open position, the spreader 66 forces the closure members 34, 44 apart from each other. The spreader 66 is spaced between the upper flanges 39, 49 of the profile members 30, 40 and opens the mouth 26 of the package 10 as the slider housing 52 is moved along the recloseable package 10 in the direction toward where the triangle of spreader 66 "points." The opening happens because the triangular shape of the spreader 66 operates as a cam to force the profile members 30, 40 apart, and thus to disengage the interlocking members 34, 44. To close the closure mechanism 12, the slider housing 12 is moved relative to the closure mechanism 12 in the opposite direction. The closing happens because the slide channel 77 between the sidewalls 72, 74 is narrower at end 56 (the end away from the spreader 66) and is wider at the end 55 (the end near the spreader 66). The spreader 66 does not depend very far downwardly into the closure mechanism 12, and it never actually passes between the interlocking members 34, 44. Thus, this helps to prevent leaks in the closure mechanism 12, when the slider device 50 is in the closed position. The slider device housing 52 may be moved until the first finger 92 abuts edge of the notch 28. To open the package 10, the slider housing 52 is moved in the opposite direction to the open position . Note that no extra tools are needed for operation.

Additional information on slider devices is disclosed in U. S. patent application Ser. No. 09/365,215, filed Jul. 30, 1999, and incorporated herein by reference in its entirety.

To construct the flexible recloseable package 10 with a slider device 50, the package 10 may be formed by either a blown extrusion process or by using a pre-formed roll of film. The film is folded in the form shown in FIG. 1. The closure mechanism 12 may be applied to the film panel sections 13, 14 by heat sealing the bonding strips 32, 42 to the film sections. The notch 28 may be cut into the upper flanges 39, 49. Next, the side seals at edges 20, 22 may be formed, for example by ultrasonic crushing. The slider 50, in particular housing 52, is then mounted over the closure mechanism 12, for example, by sliding it onto the notch 28. The sequence of these steps may be rearranged as preferred, however it is preferred that the closure mechanism 12 with notch 28 is attached to panel sections 13, 14 prior to mounting slider 50.

As indicated previously, one preferred technique for manufacturing the slider housing 52 is injection molding. While other methods are possible, injection molding is convenient and preferred. In addition, injection molding allows for ornamental features, such as ribs 75, to be molded as part of the housing 52.

C. Methods and Apparatus for Mounting the Slider Device

Figure 7:
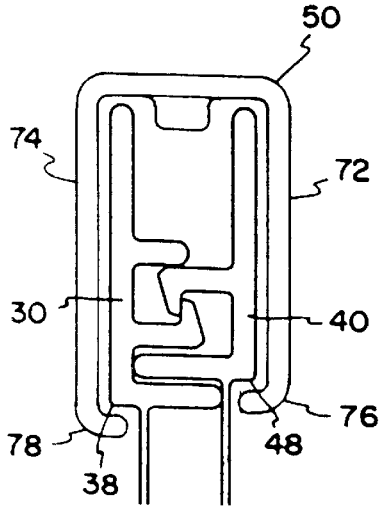
FIG. 7 is a schematic view of the profiled elements of FIG. 2 having the slider device of FIGS. 1 and 3 through 6 attached thereto.

Referring now to FIG. 7, slider device 50 has been mounted onto closure mechanism 12 so that the legs, e.g., first and second hooking constructions 76, 78, snap over and engage shoulders 38, 48, of closure profiles 30, 40, respectively. Processes for mounting slider device 50 onto closure mechanism 12 of package 10 are provided below.

Figure 8:
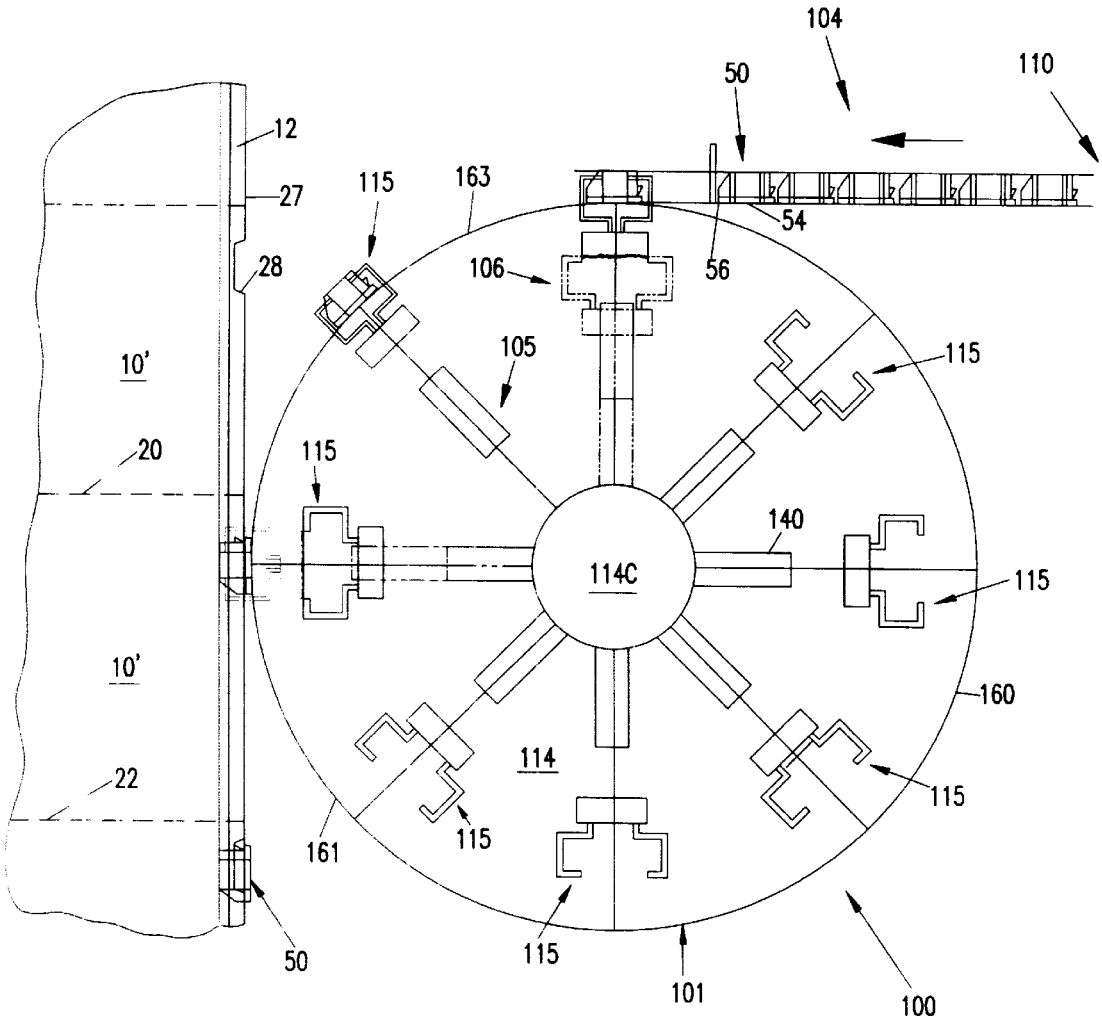
FIG. 8 is a schematic illustration of a method of applying a slider device to a recloseable package, according to an example embodiment of the present invention.

A schematic top plan view of mounting apparatus 100 and the process of one embodiment are shown in FIG. 8. Mounting apparatus 100 includes, in general, a slider device supply system 104 for providing slider device 50 to be mounted onto package 10, a slider device transporting system 105 for transporting and positioning slider device 50, and a slider device distortion system 106 for distorting slider device 50 so that slider device 50 can be mounted on package 10.

As illustrated in FIG. 8, slider device transportation system 105 includes slider device positioner 101. Slider device positioner 101 receives slider device 50 from slider device supply system 104 and mounts slider device 50 onto closure mechanism 12 of package 10'. Package 10' moves downward from the top to the bottom (as shown in FIG. 8).

Overall, mounting apparatus 100 is stationary with respect to packages 10'; however, a portion of mounting apparatus 100, slider positioner 101, rotates in the illustrated embodiment in a counterclockwise direction during the transporting and positioning of slider device 50. It will be appreciated that the direction, speed, and the like of the various parts of the apparatus and of the packages can be varied.

Inchoate packages 10', which have not been formed as individual bags, are shown in FIG. 8 as having slider devices 50 being mounted thereon. In preferred embodiments, inchoate packages 10' are positioned to be tangential to slider positioner 101 and to intersect with positioner 101 at a point, shown as "9 o'clock" (if the carousel 114 of slider positioner 101 were a clock face) in FIG. 8. Top edge 27 is shown as the right most point of package 10' closest to positioner 101; bottom edge 25 (not shown) would be at the left of the figure. Similar to packages 10, inchoate packages 10' comprise opposing panel sections 13, 14 (not shown), typically polymeric film sheets, and closure mechanism 12 attached to panels 13, 14. Packages 10' are connected at side edges 20, 22; that is, the bags have interior compartment 24 formed by seams at points where side edges 20, 22 would be, but bags have not been separated yet and remain as a continuous web. In some embodiments, the polymeric webs may not yet have any welds or seams that correspond to edges 20, 22. Preferably, however, notch 28 is present in closure mechanism 12 to aid mounting slider device 50 on closure mechanism 12. Notch 28 is shown positioned close to edge 20. Further, in some embodiments, the described method and apparatus can be used to mount slider device 50 on completed package 10.

Slider Device Supply System

Slider device supply system 104 provides slider devices 50 that are subsequently mounted on closure mechanism 12 by the slider device distortion system 106 and slider device transportation system 105. Slider device supply system 104 includes a source 110 of slider devices 50 so that slider devices 50 can be continuously mounted on closure mechanism 12. A conveyor system, trough, slide, chute, bowl feeder, or the like can be used to uniformly provide slider devices 50 for mounting. As illustrated in FIG. 8, a plurality of slider devices 50 is retained in stacked configuration by slider feed chute 110 and are fed to the slider transportation system 105 at the "12 o'clock" position. Preferably, sliders 50 are fed to slider device transportation system 105 in a predetermined position. By "predetermined position", it is meant that each slider device 50 is oriented in the position desired so as to be engaged by slider positioner 101 and mounted onto closure mechanism 12. It may be desired to include an automated device to orient slider devices 50 to the desired predetermined position. Preferably, each slider 50 is positioned with top wall 54 facing slider positioner 101. If notch 28 in package 10' is closest to side edge 20 of package 10', as shown in FIG. 8, second end 56 of slider housing 52 is preferably the leading face of slider device 50.

Slider Device Transportation System

Mounting apparatus 100 generally comprises a continually regenerating slider device transportation system 105 for slider devices 50, such as rotatable carousel 114. In the particular embodiment illustrated in FIG. 8, rotatable carousel 114 has eight equidistant spaced radially extending posts 140 and guide rail 160. It will be appreciated that the number of posts can be varied. In the preferred embodiment illustrated, posts 140 extend from a central rotation axis 114C of carousel 114 and terminate at guide rail 160. Guide rail 160 does not rotate with posts 140 but is stationary with respect to feed chute 110.

Slider Device Distortion System

In preferred arrangements, mounting apparatus 100 includes slider device distortion system 106 for distorting slider device 50. According to preferred methods slider device 50 is mounted on closure mechanism 12 after having at least one of first and second hooking constructions 76, 78 elastically distorted by the slider device distortion system 106 so that the distance between two hooking constructions 76, 78 increases. By the term "distorted" or "elastically distorted", it is meant that hooking constructions 76, 78 are forced from their stable, steady state position by some force, but when the force is removed, hooking constructions 76, 78 return to their original shape. Once the distance between the two legs is increased, slider device 50 can be easily mounted on closure mechanism 12.

Preferably, the slider device distortion system 106 is attached to the distal end of post 140. In general, slider device distorting system 106 includes hook distorting apparatus 115. In preferred methods, hook distorting apparatus 115 provides controlled motion, both lateral and radial, to slider device 50 from slider device supply system 104 until slider device 50 is mounted on closure mechanism 12.

Figure 9:
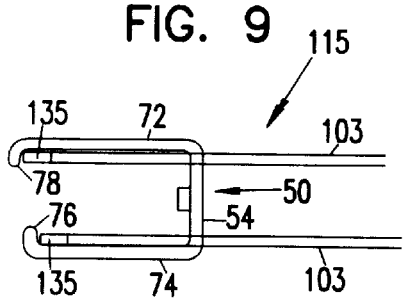
FIG. 9 is a cross-sectional schematic illustration of a method of applying a slider device to a recloseable package including a hook distorting apparatus engaging a slider device.

Preferably, on the periphery end, that is the distal end, of each post 140 is attached hook distorting apparatus 115 for engagement with slider device 50. FIG. 8 illustrates hook distorting apparatus 115 at the distal end of post 140. An enlarged view of hook distorting apparatus 115 with slider device 50 engaged therein is shown in FIG. 9.

When post 140 is within the portion of guide rail 160 defined by section 161, hook distorting apparatus 115 is empty; that is, no slider device 50 is engaged and carried by hook distorting apparatus 115. When post 140 is within the portion of guide rail 160 defined by section 163, hook distorting apparatus 115 is engaged with slider device 50 to impart lateral and radial motion to slider device 50.

Hook Distorting Apparatus

Hook distorting apparatus 115 includes slider expander guides 103 for distorting first and second hooking constructions 76, 78, which facilitates mounting slider device 50 onto closure mechanism 12. Slider expander guides 103, together with positioner 101, provide the placement of slider device 50 to achieve proper positioning of slider device 50 onto closure mechanism 12. While a variety of embodiments are contemplated, FIGS. 8 through 11 illustrate the slider expander guides 103 as a "side entry fingers" arrangement. Expander guides 103, in particular, contact surface 135, is used to expand first and second hooking construction 76, 78 of slider device 50 as slider device 50 progresses from the "12 o'clock" position to the "9 o'clock" position.

Hook distorting apparatus 115 is attached to the distal end of post 140. Hook distorting apparatus 115 includes at least two slider device expander guides 103 that are planar with each other and separated by a distance no greater than the spacing between first and second side walls 72, 74 of slider device 50. Slider device expander guides 103 extend from the post 140 away from axis of rotation 114C a first length. At an end of the length of slider expander guide 103 furthest from the axis of rotation 114C, is located a contact surface 135. Contact surface 135 is attached to slider expander guide 103 and forms an angle; in the particular embodiment illustrated, it is a 90 degree angle with slider expander guide 103. Contact surface 135 is constructed and arranged to enter slider device 50 at slider device 50 first end 56 and second end 55 and between first side wall 72 and second side wall 74 of slider device 50. Contact surface 135 will preferably cover at least a portion of the slider device 50 slide channel 77. A first expansion device (not shown) is located between the slider device expander guides 103 to move the slider device expander guides 103 that contact first side wall 72 of slider device 50 away from slider expander guides 103 that contact second side wall 74 of slider device 50 in a direction away from each other (in FIGS. 9 and 10 it is a vertical direction) and increase the distance between first and second side walls 72, 74 of slider device 50 engaged in the hook distorting apparatus 115. A second expansion device (not shown) is located between the slider device expander guides 103 to move slider expander guides or fingers 103 that enter first end 56 of slider device 50 away from slider expander guides 103 that enter second end 55 of slider device 50 in a lateral direction. The second expansion device inserts and removes the fingers 103 from the first end 56 and second end 55 of the slider device 50. The second expansion device moves the fingers 103 in direction perpendicular to the direction the first expansion device moves the fingers. Preferably the expansion devices are air cylinders or the like. The slider expander guides 103 can be constructed and arranged in any shape such as for example an L-shape or a U-shape as shown in FIG. 8.

To mount slider device 50 onto recloseable closure mechanism 12 of inchoate package 10' or package 10 according to the principles of this disclosure, hook distorting apparatus 115, engages a slider device 50 from slider device supply system 104. In FIG. 8, this action is shown at the "12 o-clock" position. Hook distorting apparatus 115 rotates counterclockwise by the slider device transportation system 105 from the "12 o'clock" position to the "9 o'clock" position. At the "9 o'clock" position, slider device 50 is mounted onto resealable closure mechanism 12 of package 10' at notch 28.

At the "12 o'clock" position, the hook distorting apparatus 115 may extend from a retracted position to an extended position as illustrated on FIG. 8. In the retracted position, slider expander guides 103 of hook distorting apparatus 115 are in an "open" position. By "open" it is meant that hook distorting apparatus 115 slider expander guides 103 can surround slider device 50 without touching the sides 55, 56 of slider device 50. Once in the extended "12 o'clock" position, slider expander guides 103 that enter first end 56 of slider device 50 move towards slider expander guides 103 that enter second end 55 of slider device 50 in a lateral direction slider expander guides 103; thus, slider expander guides "close" and engage slider device 50 within the hook distorting apparatus 115. Slider expander guides 103 enter at least one of the two sides 55, 56 of slider device 50 and contact slide channel 77 of slider device 50. There are at least two slider expander guides or "fingers" 103. At least one finger 103 contacts a first side wall 72 of slide channel 77 and at least one finger 103 contacts a second side wall 74 of slide channel 77. Preferably, four fingers 103 contact slide channel 77. Most preferably, a first pair of two fingers 103 enter a first end 56 of slider device 50. The first pair of fingers 103 includes a first finger 103 and a second finger 103. The first finger 103 contacts the first side wall 72 of slide channel 77 and the second finger 103 contacts the second side wall 74 of slide channel 77. The second pair of fingers 103 includes a third finger 103 and a fourth finger 103. The second pair of fingers 103 enter a second end 55 of slider device 50. Third finger 103 contacts the first sidewall 72 of slide channel 77 and the fourth finger contacts the second sidewall 74 of slide channel 77.

As engaged slider device 50 moves from the "12 o'clock" position to the "9 o'clock" position, finger 103 or fingers 103 contacting the first side wall 72 of slide channel 77 move away from finger 103 or fingers 103 contacting the second side wall 74 of slide channel 77 and expand first and second hooking constructions 76, 78 of slider device 50. That is, as slider device 50 progresses along the rotation path, the contact surfaces 135 of fingers 103 separate first and second hooking construction 76, 78, thereby increasing the distance therebetween. The expansion of first and second hooking constructions 76, 78 is preferably continuous and constant from the "12 o'clock" to the "9 o'clock" position.

At the "9 o'clock" position, the process that occurred at the "12 o'clock" position is reversed. At the "9 o'clock" position, hook distorting apparatus 115 may move into the "open" position. That is, fingers 103 that enter first end 56 of slider device 50 move away from fingers 103 that enter second end 55 of slider device 50 in a lateral direction until the terminal ends of fingers 103 extend beyond or "clear" the edge of slider device 50 first and second sides 56, 55. Once fingers 103 "clear" first and second sides 56, 55 of slider device 50, hook distorting apparatus 115 retracts away from mounted slider device 50 towards the axis of rotation 114C as shown in FIG. 8. In the retracted position, hook distorting apparatus 115 travels counterclockwise to the "12 o'clock" position, and the cycle repeats.

Figure 10:
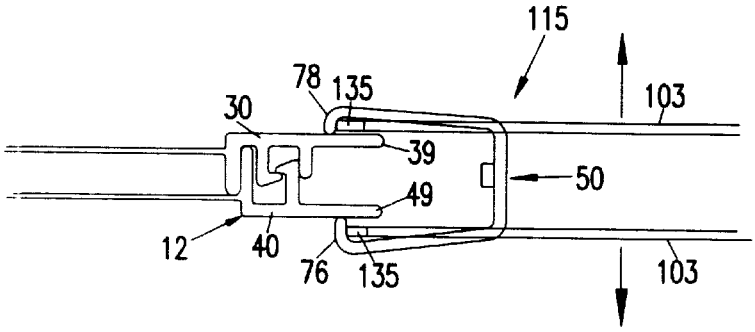
FIG. 10 is a cross-sectional schematic illustration of a further step in the method of FIG. 9 of applying a slider device to a recloseable package; the hook distorting apparatus having expanded the slider devices and the slider device being mounted on the recloseable package.
Figure 11:
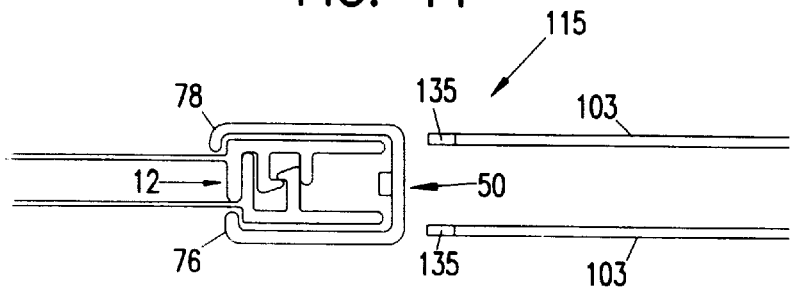
FIG. 11 is a cross-sectional schematic illustration of yet a further step in the method of FIG. 9 of applying a slider device to a recloseable package; the slider device being mounted on the recloseable package and the hook distorting apparatus being disengaged from the slider device.

The process for mounting slider device 50 onto closure mechanism 12 is further shown in FIGS. 9 through 11. FIG. 9 illustrates an enlarged side view of hook distorting apparatus 115 having slider device 50 engaged on slider expander guides or fingers 103 entering into the sides of slider device 50 and positioned within slide channel 77 of slider device 50. FIGS. 10 and 11 show slider device 50 being mounted onto closure mechanism 12 having first and second closure profiles 30, 40. First and second hooking constructions 76, 78 are distorted from their original position (shown in FIGS. 3 through 7) to facilitate the mounting of slider device 50 onto closure mechanism 12. By "distorted", it is meant that hooking constructions 76, 78 experience elastic deformation; that is, the shape of each of at least one of hooking constructions 76, 78 is deformed by some force, and when the force is removed, hooking constructions 76, 78 returns to its original shape before being deformed.

Before mounting slider device 50 onto closure mechanism 12, slider device 50 is positioned within hook distorting apparatus 115 that aligns slider device 50 with closure mechanism 12 on which slider device 50 will be mounted. Hook distorting apparatus 115 can be configured for manual placement of slider device 50 therein, or slider device 50 may be deposited into hook distorting apparatus 115 by any automated mechanism. Preferably, a continuous supply of slider devices 50 is fed to the hook distorting apparatus 115 by slider device supply system 104.

As illustrated in FIGS. 9 through 11, slider expander guides 103 are attached at one end to hook distorting apparatus 115 and are used to distort first and second hooking constructions 76, 78. Each slider expander guide or finger 103, is attached to contact surfaces 135, which contacts the sides of slide channel 77.

FIG. 9 shows slider device 50 held in hook distorting apparatus 115 in a manner so that top wall 54 of slider housing 52, is facing rotation axis 114C. Slider device 50 is positioned so that first and second hooking constructions 76, 78 extend outward from hook distorting apparatus 115 toward closure mechanism 12.

Fingers 103 enter at least one side 56, 55 of slider device 50 and contact at least a portion of slide channel 77. As described above, at least one finger 103 is in contact with a first side of slide channel 77 and at least another finger 103 is in contact with a second side of slide channel 77. Preferably, two fingers 103 are in contact with a first side of slide channel 77 and two more fingers 103 are in contact with a second side of slide channel 77. Preferably, two fingers 103 enter a first side 56 of slider device 50 and two fingers 103 enter a second side 55 of slider device 50.

FIG. 10 shows recloseable closure mechanism 12, comprising first and second closure profiles 30, 40, positioned so that first and second upper flanges 39, 49 extend toward slider device 50 in hook distorting apparatus 115. As described above, package 10 may exist as an individual package 10 or as inchoate package 10' during the process of attaching slider device 50. Additionally, slider device 50 can be mounted onto closure mechanism 12 without closure mechanism 12 being attached to first and second panel sections 13, 14.

FIG. 10 shows how first and second hooking constructions 76, 78 are distorted by slider expander guides or fingers 103. Finger or fingers 103 in contact with a first side of slider device 50 are moved away from finger or fingers 103 in contact with a second side of slider device 50. Thus, first and second hooking constructions 76, 78 are distorted or bent outward away from each other, thereby increasing the overall width of slider housing 52 at that point. With the width of housing 52 increased, slider device 50 can be positioned over closure mechanism 12 until slider device 50 is snapped over shoulders 38, 48, as shown in FIG. 11. First and second closure profiles, in particular upper flanges 39, 49, and other portions of closure mechanism 12 may be slightly distorted inward by the force of pushing slider device 50 over closure mechanism 12.

To achieve proper placement of slider device 50 onto closure mechanism 12, closure mechanism 12 is preferably securely held in some manner during the mounting process so that any displacement of closure mechanism 12 in respect to hook distorting apparatus 115 is minimized.

FIG. 11 shows contact surfaces 135 in the "open" and "retracted" position. Once slider device 50 is mounted on closure mechanism 12 the terminal ends of fingers 103 move away from each other in a lateral direction until the terminal ends of fingers 103 "clear" mounted slider device 50. Once the fingers 103 "clear" mounted slider device 50, hook distorting apparatus 115 retracts as shown in FIG. 11. In the "open" position, hook distorting apparatus 115 is ready to accept another slider device 50 for mounting onto another closure mechanism 12. The "open" and "retracted" hook distorting apparatus 115 travels counterclockwise to the "12 o'clock" position and the cycle starts again.

The above specification and examples are believed to provide a complete description of the manufacture and use of particular embodiments of the invention. Many embodiments of the invention can be made.

We claim:

1. A method of mounting a slider device on a recloseable closure arrangement for a recloseable package; the method comprising:

(a) providing a package having a recloseable closure mechanism;

(b) providing a slider device for opening and closing the recloseable closure mechanism, the slider device having first and second leg constructions having a first distance therebetween;

(c) expanding the slider device to increase the first distance between the first and second leg constructions to a second distance, wherein the expanding comprises inserting an expanding device into a slide channel between first and second leg constructions and moving the first leg construction away from the second leg construction;

(d) removing the slider device from the expanding device;

(e) mounting the slider device onto recloseable closure mechanism; and (f) decreasing the second distance between the first and second leg constructions to the first distance.

2. The method according to claim 1 wherein the step of providing the slider device comprises using a rotating carousel having a central axis to move the slider device from a chute to a track.

3. The method according to claim 2 wherein the step of providing the slider device comprises using the rotating carousel including a radially extending hook distorting apparatus to engage the slider device.

4. The method according to claim 3 wherein the step of providing the slider device comprises using the rotating carousel including a plurality of radially extending hook distorting apparatuses to engage a plurality of slider devices.

5. The method according to claim 1 wherein the step of expanding the slider device to increase the first distance between the first and second leg constructions to a second distance comprises using an expanding device with four inserting fingers.

6. An apparatus for mounting a slider device to a recloseable closure mechanism, the slider device having first and second opposite leg constructions having a first distance therebetween, the apparatus comprising:

(a) a slider device positioner system comprising a rotating carousel;

(b) a slider distorting apparatus comprising an expanding device with four contact surface fingers adapted to insert into a slider side channel and expand at least one of the first and second leg constructions from the first distance to a second distance; and (c) a slider mounting system constructed and arranged to align the slider device with the recloseable closure mechanism.

7. The apparatus according to claim 6 wherein the rotating carousel comprises a plurality of radially extending posts.

8. The apparatus according to claim 7 wherein each of the plurality of radially extending hook distorting apparatuses is constructed and arranged to engage with the slider device.

9. A method of mounting a slider device on a recloseable closure mechanism for a resealable package; the method comprising:

(a) providing a package having a recloseable closure mechanism;

(b) providing a slider device for opening and closing the recloseable closure mechanism, the slider device having first and second leg constructions having a first distance therebetween;

(c) positioning the slider device by using a rotating carousel comprising a plurality of radially extending posts, each post having an expanding device including four insertion fingers thereon, and each post constructed and arranged to engage the slider device;

(d) moving the slider device along a radial path of the carousel;

(e) expanding the slider device to increase the first distance between the first and second leg constructions to a second distance;

(f) decreasing the second distance between the first and second leg constructions to the first distance;

(g) mounting the slider device onto recloseable closure mechanism; and (h) removing the slider device from the expanding device.

10. The method according to claim 9 wherein the steps of moving the slider device and expanding the slider device are done simultaneously.

11. The method according to claim 9 wherein the step of expanding the slider device to increase the first distance between the first and second leg constructions to a second distance comprises inserting a first finger into a slider device first end and inserting a second finger into a slider device second end.

12. The method according to claim 11 wherein the step of expanding the slider device to increase the first distance between the first and second leg constructions to a second distance comprises contacting a slide channel first wall with the first finger and contacting a slide channel second wall with the second finger.

13. the method according to claim 9 wherein the step of expanding the slider to increase the first distance between the first and second leg construction to a second distance comprises inserting a first finger pair into a slider device first end inserting a second finger pair into a slider device second end.

14. The method according to claim 13 wherein the step of expanding the slider device to increase the first distance between the first and second leg constructions to a second distance comprises engaging the slide channel first wall with the first finger pair and engaging the slide channel second wall with the second finger pair.

15. The method according to claim 14 wherein the step of expanding the slider device to increase the first distance between the first and second leg constructions to a second distance comprises moving the two fingers engaged with the slide channel first wall away from the two fingers engaged with the slide channel second wall.

16. The method according to claim 15 wherein the step of removing the slider device from the expanding device comprises removing the fingers from slider device first end and removing the fingers from the slider device second end.

17. The method according to claim 16 wherein the step of removing the slider device from the expanding device comprises moving the expanding device toward an axis of the rotating carousel.

* * * * *